US005603385A

United States Patent [19]

Colebrook

[11] Patent Number: 5,603,385

[45] Date of Patent: Feb. 18, 1997

[54] ROTATABLE PRESSURE SEAL

[75] Inventor: Mark A. Colebrook, Cheltenham, England

[73] Assignee: Camco Drilling Group Limited, Stonehouse, England

[21] Appl. No.: 454,992

[22] Filed: May 31, 1995

[30] Foreign Application Priority Data

Jun. 4, 1994 [GB] United Kingdom ..... 9411228

[51] Int. Cl.[6] ..... E21B 47/02

[52] U.S. Cl. ..... 175/45; 175/61; 175/73

[58] Field of Search ..... 175/45, 61, 73, 175/26, 325.4, 106, 228

[56] References Cited

U.S. PATENT DOCUMENTS

| | | | |
|---|---|---|---|
| 4,088,426 | 5/1978 | Edwards | 418/8 |
| 4,391,450 | 7/1983 | Beck . | |
| 4,660,656 | 4/1987 | Warren et al. | 175/26 |
| 4,776,410 | 10/1987 | Perkin et al. | 175/325.4 |
| 4,792,000 | 12/1988 | Perkin et al. | 175/228 |
| 4,830,122 | 5/1989 | Walter | 175/106 |
| 5,265,682 | 11/1993 | Russell et al. | 175/45 |

FOREIGN PATENT DOCUMENTS

| | | |
|---|---|---|
| 0614999 | 9/1994 | European Pat. Off. . |
| 2232458 | 12/1990 | United Kingdom . |
| 2257182 | 1/1993 | United Kingdom . |
| 2259316 | 3/1993 | United Kingdom . |
| 2278865 | 12/1994 | United Kingdom . |

*Primary Examiner*—Frank Tsay

[57] ABSTRACT

A rotatable pressure seal between a relatively rotatable shaft and body structure comprises two annular sealing discs concentric with the shaft, one disc being mounted on the body structure and the other disc being carried on the shaft the discs having engaging sealing faces formed of polycrystalline diamond or other superhard material. The pressure seal is particularly for use in a modulated bias unit, for controlling the direction of drilling of a rotary drill bit when drilling boreholes in subsurface formations. The bias unit comprises a number of hydraulic actuators spaced apart around the periphery of the unit, and a selector control valve modulates the fluid pressure supplied to each actuator in synchronism with rotation of the drill bit so that, as the drill bit rotates, a thrust member of each actuator is displaced outwardly at the same selected rotational position so as to bias the drill bit laterally and thus control the direction of drilling. The selector control valve is located within a cavity in the body structure and is operated by a shaft which extends into the cavity through a pressure seal according to the invention.

17 Claims, 4 Drawing Sheets

FIG 4
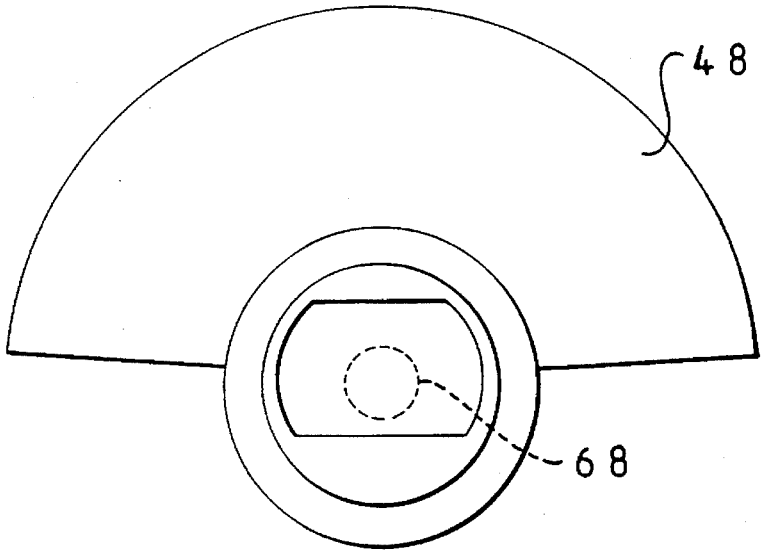
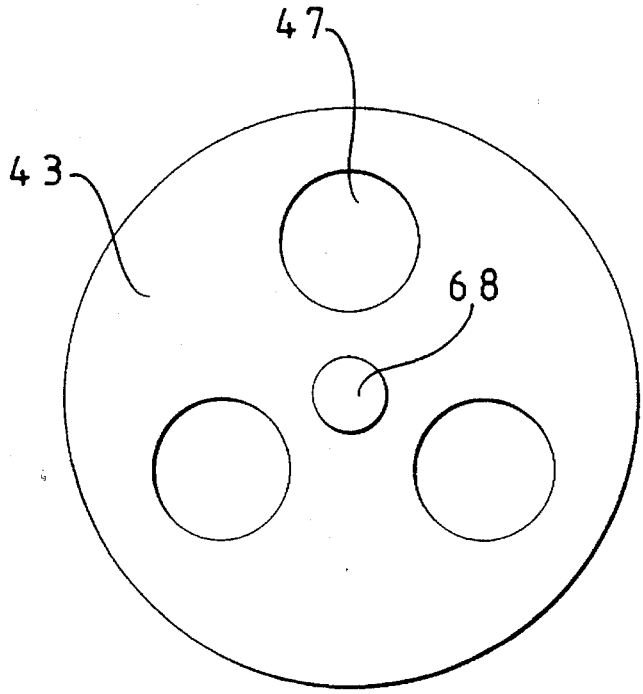
FIG 5

ROTATABLE PRESSURE SEAL

BACKGROUND OF THE INVENTION

The invention relates to a rotatable pressure seal between a rotatable shaft and a body structure. The pressure seal is particularly but not exclusively suitable for use in a modulated bias unit used in drilling boreholes in subsurface formations. The invention will therefore be described in that context, but it will be appreciated that it is more widely applicable to many other situations where a rotatable pressure seal is required.

When drilling or coring holes in subsurface formations, it is often desirable to be able to vary and control the direction of drilling, for example to direct the borehole towards a desirable target or to control the direction horizontally within the payzone once the target has been reached. It may also be desirable to correct for deviations from the desired direction when drilling a straight hole, or to control the direction of the hole to avoid obstacles.

British Patent Specification No. 2259316 describes various arrangements in which there is associated with the rotary drill bit a modulated bias unit. The bias unit comprises a number of hydraulic actuators spaced apart around the periphery of the unit, each having a movable thrust member which is hydraulically displaceable outwardly for engagement with the formation of the borehole being drilled. Each actuator has an inlet passage for connection to a source of drilling fluid under pressure and an outlet passage for communication with the annulus. A selector control valve connects the inlet passages in succession to the source of fluid under pressure, as the bias unit rotates. The valve serves to modulate the fluid pressure supplied to each actuator in synchronism with rotation of the drill bit, and in selected phase relation thereto whereby, as the drill bit rotates, each movable thrust member is displaced outwardly at the same selected rotational position so as to bias the drill bit laterally and thus control the direction of drilling.

The selector control valve is located within a cavity in the body structure of the bias unit and is operated by a shaft which is rotatable relative to the body structure. Drilling fluid is supplied to the cavity through a choke and consequently there is a significant pressure difference between the interior of the cavity and a central passage where the main part of the shaft is located. In order to accommodate this pressure difference a rotatable pressure seal must be provided between the shaft and the body structure of the bias unit. The pressure seal must operate reliably under conditions of high pressure and temperature, and must be able to resist the highly abrasive effect of the drilling fluid. It must also operate under low torque. The present invention therefore provides a novel form of pressure seal which is particularly suitable for use in a modulated bias unit of the kind described, although it may also be suitable for use in other situations where a reliable rotatable pressure seal is required.

SUMMARY OF THE INVENTION

According to the invention there is provided a rotatable pressure seal between a relatively rotatable shaft and body structure, comprising two annular sealing members concentric with the shaft, one member being mounted on the body structure and the other member being carded on the shaft, the members having engaging sealing faces formed of superhard material, Preferably said sealing members are annular discs and the engaging sealing faces are substantially flat. Examples of suitable superhard materials are polycrystalline diamond, cubic boron nitride and amorphous diamond-like carbon (ADLC). Each sealing member may comprise a layer of superhard material bonded to a substrate of less hard material.

In order to accommodate relative axial movement between the shaft and body structure the sealing member carried on the shaft is preferably provided on a carrier which is axially displaceable with respect to the shaft.

Said carrier may comprise a cylindrical sleeve surrounding the shaft, the sealing member being mounted on one annular end face of the sleeve, said sleeve being slidable axially of the shaft and resilient annular fluid-fight sealing means being disposed between the sleeve and the shaft.

The portion of the shaft passing through the carrier may reduce in cross-section and engage a correspondingly reducing cross-section passage in the carrier, whereby the effective cross-sectional area of the carrier on which, in use, a higher pressure acts, is less than the area of the seal between the sealing members, so as at least partly to balance the opposing forces, due to pressure, acting on the carrier.

Preferably means are provided to allow the longitudinal axis of the shaft to tilt relative to the longitudinal axis of the carrier, so as to permit said sealing faces to remain in sealing engagement upon tilting of the shaft relative to the body structure. Said means may comprise a sleeve of resiliently deformable material disposed between an internal surface on the carrier and an external surface on said shaft.

The invention also provides a component for use downhole when drilling boreholes in subsurface formations and including a body structure and a shaft which is rotatable relative to the body structure and extends through two regions which, in use of the component, are subject to different fluid pressures, said regions being separated by a rotatable pressure seal comprising two annular sealing members concentric with the shaft, one member being mounted on the body structure and the other member being carried on the shalt, the members having engaging sealing faces formed of superhard material.

The pressure seal of the component may also include any of the other pressure seal features referred to above.

The invention further provides a modulated bias unit, for controlling the direction of drilling of a rotary drill bit when drilling boreholes in subsurface formations, comprising at least one hydraulic actuator having a movable thrust member which is hydraulically displaceable outwardly for engagement with the formation of the borehole being drilled, valve means which modulate fluid pressure; supplied to the actuator in synchronism with rotation of the drill bit, and in selected phase relation thereto so that, as the drill bit rotates, the movable thrust member is displaced outwardly at the same selected rotational position so as to bias the drill bit laterally and thus control the direction of drilling, said valve means being located within a cavity in the body structure and operated by a shaft which is rotatable relatively to the body structure and extends into said cavity through a rotatable pressure seal, said pressure seal comprising two annular sealing members concentric with the shaft, one member being mounted on the body structure and the other member being carried on the shaft, the members having engaging sealing faces formed of superhard material.

Said valve means may be located between a source of fluid under pressure and said hydraulic actuator, and operable to place said actuator alternately into and out of communication with said source of fluid under pressure.

Said hydraulic actuator may comprise a chamber located adjacent the outer periphery of the unit, inlet means for supplying fluid to said chamber from said source of fluid under pressure, outlet means for delivering fluid from said chamber to a lower pressure zone, and a movable thrust member mourned for movement outwardly and inwardly with respect to the chamber in response to fluid pressure therein.

There may be provided a plurality of said hydraulic actuators spaced apart around the periphery of the unit, said valve means being arranged to modulate the fluid pressure supplied to said actuators so as to operate each actuator in succession as the unit rotates.

The modulated bias unit may further comprise a formation-engaging member pivotally mounted on the body structure for pivotal movement about a pivot axis located to one side of said movable thrust member, the formation-engaging member being operatively coupled to the thrust member whereby outward movement of the thrust member causes outward pivoting movement of the formation-engaging member.

The pressure seal of the modulated bias unit may also include any of the other pressure seal features referred to above.

DETAILED DESCRIPTION OF THE PREFERRED EMBODIMENTS

Figure 1:
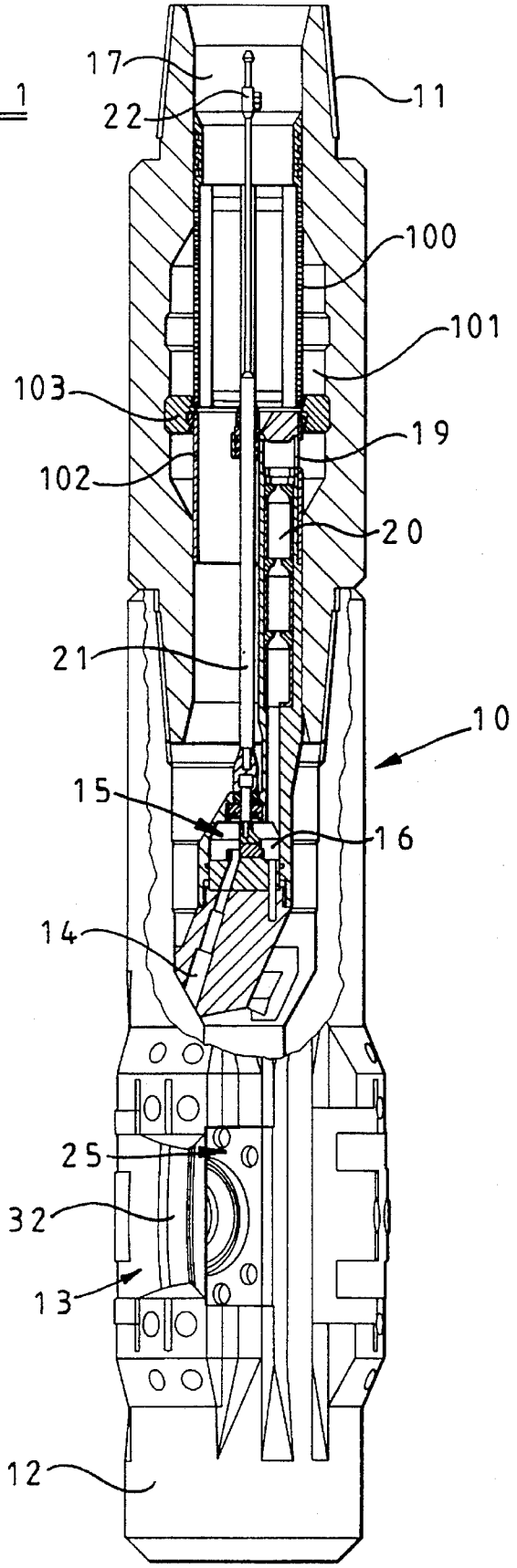
FIG. 1 is a pan longitudinal section, part side elevation of a modulated bias unit in accordance with the invention.

Referring to FIG. 1, the bias unit comprises an elongate main body structure 10 provided at its upper end with a tapered externally threaded pin 11 for coupling the unit to a drill collar, incorporating a control unit, for example a roll stabilised instrument package, which is in turn connected to the lower end of the drill string. The lower end 12 of the body structure is formed with a tapered internally threaded socket shaped and dimensioned to receive the standard form of tapered threaded pin on a drill bit. In the aforementioned British Patent Specification No. 2259316 the exemplary arrangements described and illustrated incorporate the modulated bias unit in the drill bit itself. In the arrangement shown in the accompanying drawings the bias unit is separate from the drill bit and may thus be used to effect steering of any form of drill bit which may be coupled to its lower end.

There are provided around the periphery of the bias unit, towards its lower end, three equally spaced hydraulic actuators 13, the operation of which will be described in greater detail below. Each hydraulic actuator 13 is supplied with drilling fluid under pressure through a passage 14 under the control of a rotatable disc valve 15 located in a cavity 16 in the body structure of the bias unit.

Drilling fluid delivered under pressure downwardly through the interior of the drill string, in the normal manner, passes into a central passage 17 in the upper part of the bias unit and flows outwardly through a cylindrical filter screen 100 into a surrounding annular chamber 101 formed in the surrounding wall of the body structure of the bias unit. The filter screen 100, and an imperforate tubular element 102 immediately below it, are supported by an encircling spider 103 within the annular chamber 101. Fluid flowing downwardly past the spider 103 to the lower part of the annular chamber 101 flows through an inlet 19 into the upper end of a vertical multiple choke unit 20 through Which the drilling fluid is delivered downwardly at an appropriate pressure to the cavity 16.

The disc valve 15 is controlled by an axial shaft 21 which is connected by a coupling 22 to the output shaft (not shown) of the aforementioned control unit (also not shown) in a drill collar connected between the pin 11 and the lower end of the drill string.

The control unit may be of the kind described and claimed in British Patent Specification No, 2257182.

During steered drilling, the control unit maintains the shaft 21 substantially stationary at a rotational orientation which is selected, either from the surface or by a downhole computer program, according to the direction in which the bottom hole assembly, including the bias unit and the drill bit, is to be steered. As the bias unit 10 rotates around the stationary shaft 21 the disc valve 15 operates to deliver drilling fluid under pressure to the three hydraulic actuators 13 in succession. The hydraulic actuators are thus operated in succession as the bias unit rotates, each in the same rotational position so as to displace the bias unit laterally away from the position where the actuators are operated. The selected rotational position of the shaft 21 in space thus determines the direction in which the bias unit is laterally displaced and hence the direction in which the drill bit is steered.

The hydraulic actuators will now be described in greater detail with particular reference to FIG. 2.

Figure 2:
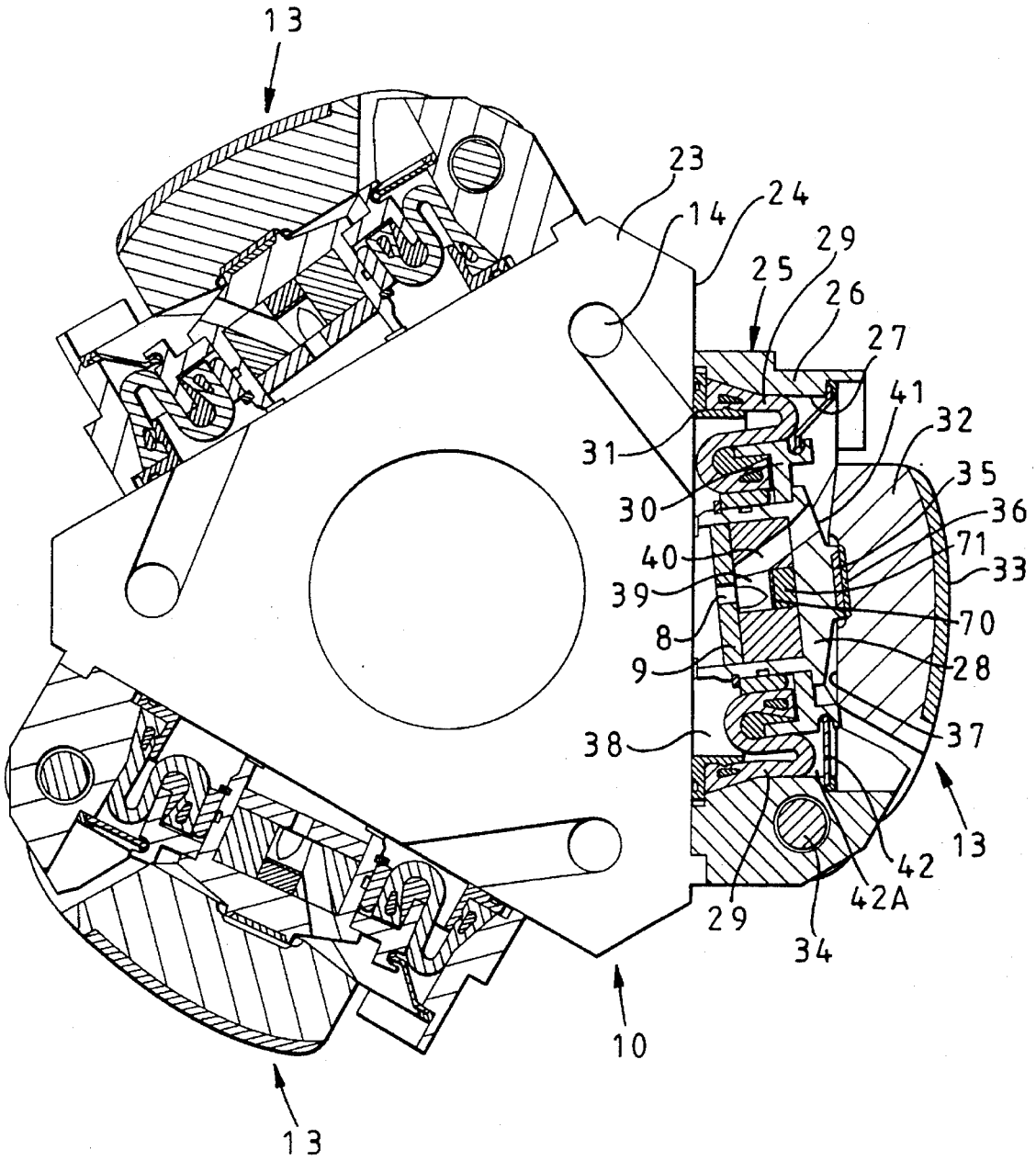
FIG. 2 is a horizontal cross-section through the bias unit, taken along the line 2—2 of FIG. 1.

Referring to FIG. 2: at the location of the hydraulic actuators 13 the body structure 10 of the bias unit comprises a central core 23 of the general form of an equilateral triangle so as to provide three outwardly facing flat surfaces 24.

Mounted on each surface 24 is a rectangular support unit 25 formed with a circular peripheral wall 26 which defines a circular cavity 27. A movable thrust member 28 of generally cylindrical form is located in the cavity 27 and is connected to the peripheral wall 26 by a fabric-reinforced elastomeric annular rolling diaphragm 29. The inner periphery of the diaphragm 29 is clamped to the thrust member 28 by a clamping ring 30 and the outer periphery of the rolling diaphragm 29 is clamped to the peripheral wall 26 by an inner clamping ring 31. The diaphragm 29 has an annular portion of U-shaped cross-section between the outer surface of the clamping ring 30 and the inner surface of the peripheral wall 26.

A pad 32 having a part-cylindrically curved outer surface 33 is pivotally mounted on the support unit 25, to one side of the thrust member 28 and cavity 27, by a pivot pin 34 the longitudinal axis of which is parallel to the longitudinal axis of the bias unit. The outer surface of the cylindrical thrust member 28 is formed with a shallow projection having a flat bearing surface 35 which bears against a flat bearing surface 36 in a shallow recess formed in the inner surface of the pad 32. The bearing surfaces 35 and 36 are hardfaced.

The part of the cavity 27 between the rolling diaphragm 29 and the surface 24 of the central core 23 defines a chamber 38 to which drilling fluid under pressure is supplied through the aforementioned associated passage 14 when the disc valve 15 is in the appropriate position. When the chamber 38 of each hydraulic unit is subjected to fluid under pressure, the thrust member 28 is urged outwardly and by virtue of its engagement with the pad 32 causes the pad 32 to pivot outwardly and bear against the formation of the surrounding borehole and thus displace the bias unit in the opposite direction away from the location, for the time being, of the pad 32. As the bias unit rotates away from the orientation where a particular hydraulic actuator is operated, the next hydraulic actuator to approach that position is operated similarly to maintain the displacement of the bias unit in the same lateral direction. The pressure of the formation on the previously extended pad 32 thus increases, forcing that pad and associated thrust member 28 inwardly again. During this inward movement fluid is expelled from the chamber 38 through a central choke aperture 8 formed in a plate 9 mounted on the thrust member 28, the aperture 8 communicating with a cavity 39. Three circumferentially spaced diverging continuation passages 40 lead from the cavity 39 to three outlets 41 respectively in the outwardly facing surface of the thrust member 28, the outlets being circumferentially spaced around the central bearing surface 35.

Drilling fluid flowing out of the outlets 41 washes over the inner surface 37 of the pad 32 and around the inter-engaging bearing surfaces 35 and 36 and thus prevents silting up of this region with debris carried in the drilling fluid which is at all times flowing past the bias unit along the annulus. The effect of such silting up would be to jam up the mechanism and restrict motion of the pad 32.

If the rolling diaphragm 29 were to be exposed to the flow of drilling fluid in the annulus, solid particles in the drilling fluid would be likely to find their way between the diaphragm 29 and the surfaces of the members 26 and 30 between which it rolls, leading to rapid abrasive wear of the diaphragm. In order to prevent debris in the drilling fluid from abrading the rolling diaphragm 29 in this manner, a protective further annular flexible diaphragm 42 is connected between the clamping ring 30 and the peripheral wall 26 outwardly of the rolling diaphragm 29. The flexible diaphragm 42 may be fluid permeable so as to permit the flow of clean drilling fluid into and out of the annular space 42A between the diaphragms 29 and 42, while preventing the ingress of solid particles and debris into that space.

Instead of the diaphragm 42 being fluid permeable, it may be impermeable and in this case the space 42A between the diaphragm 42 and the rolling diaphragm 29 may be filled with a flowable material such as grease. In order to allow for changes in pressure in the space between the diaphragms, a passage (not shown) may extend through the peripheral wall 26 of the support unit 25, so as to place the space between the diaphragms 42, 29 into communication with the annulus between the outer surface of the bias unit and the surrounding borehole. In order to inhibit escape of grease through such passage, or the ingress of drilling fluid from the annulus, the passage is filled with a flow-resisting medium, such as wire wool or similar material.

Each rectangular support unit 25 may be secured to the respective surface 24 of the core unit 23 by a number of screws. Since all the operative components of the hydraulic actuator, including the pad 32, thrust member 28 and rolling diaphragm 29, are all mounted on the unit 25, each hydraulic actuator comprises a unit which may be readily replaced in the event of damage or in the event of a unit of different characteristics being required.

Figure 3:
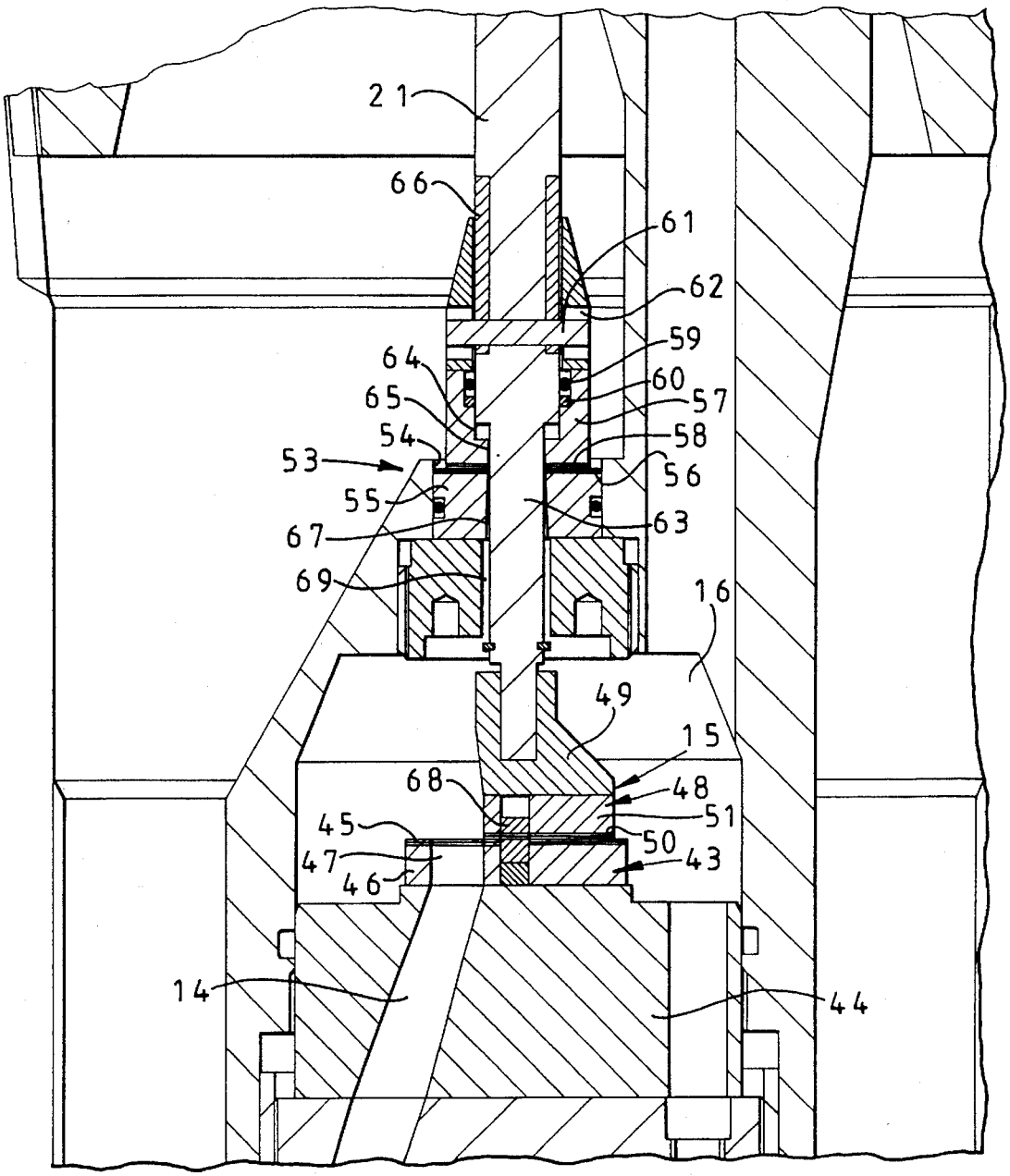
FIG. 3 is a longitudinal section, on an enlarged scale, of parts of the bias unit of FIG. 1, and FIGS. 4 and 5 are plan views of the two major components of the disc valve employed in the bias unit.

FIGS. 3–5 show in greater detail the construction of the disc valve 15 and associated components. The disc valve comprises a lower disc 43 which is fixedly mounted, for example by brazing or gluing, on a fixed pan 44 of the body structure of the bias unit. The lower disc 43 comprises an upper layer 45 of polycrystalline diamond bonded to a thicker substrate 46 of cemented tungsten carbide. As best seen in FIG. 5, the disc 43 is formed with three equally circumferentially spaced circular apertures 47 each of which registers with a respective passage 14 in the body structure.

The upper element 48 of the disc valve is brazed or glued to a structure 49 on the lower end of the shaft 21 and comprises a lower facing layer 50 of polycrystalline diamond bonded to a thicker substrate 51 of tungsten carbide. As best seen in FIG. 4, the element 48 comprises a sector of a disc which is slightly less than 180° in angular extent. The arrangement is such that as the lower disc 43 rotates beneath the upper element 48 (which is held stationary, with the shaft 21, by the aforementioned roll stabilised control unit) the apertures 47 are successively uncovered by the sector-shaped element 48 so that drilling fluid under pressure is fed from the cavity 16, through the passages 14, and to the hydraulic actuators in succession. It will be seen that, due to the angular extent of the element 48, the following aperture 47 begins to open before the previous aperture has closed.

In order to locate the elements 43 and 48 of the disc valve radially, an axial pin 68 of polycrystalline diamond is received in registering sockets in the two elements. The pin may be non-rotatably secured within one of the elements, the other element being rotatable around it. Alternatively the pin may be integrally formed with one or other of the valve elements. Instead of being formed from polycrystalline diamond, the axial pin 68 may be formed from any other superhard material, such as cubic boron nitride or amorphous diamond-like carbon (ADLC).

It will be seen that the disc valve 15 also serves as a thrust bearing between the shaft 21 and the body structure of the bias unit. The provision of mating polycrystalline diamond surfaces on the contiguous surfaces of the valve provides a high resistance to wear and erosion while at the same time providing a low resistance to relative rotation.

As previously mentioned, drilling fluid is supplied to the cavity 16 through the multiple choke arrangement 20 and consequently there is a significant pressure difference between the interior of the cavity 16 and the central passage 17 where the main pan of the shaft 21 is located. In order to accommodate this pressure difference a rotating seal 53 is provided between the shaft 21 and the body structure of the bias unit.

The seal 53 is located in a cylindrical chamber 54 and comprises a lower annular carrier 55 fixed to the body structure of the bias unit and formed at its upper surface with an annular layer 56 of polycrystalline diamond surrounding a lower reduced-diameter portion 63 of the shaft 21. The upper part of the seal comprises a sleeve 57 which is mounted on the shaft 21 and is formed on its lower end surface with an annular layer 58 of polycrystalline diamond which bears on the layer 56. The sleeve 57 is axially slideable on the shaft 21 so as to maintain the seal between the layers 56 and 58 while accommodating slight axial movement of the shaft 21. To this end an O-ring 59 is provided in an annular recess between the sleeve 57 and the shaft 21 so as to locate the sleeve 57 on the shaft while permitting the slight axial movement. A backing ring 60 is located adjacent the O-ring to prevent its being extruded from the recess in use. A pin 61 is secured through the shaft 21 and the ends of the pin are received in axial slots 62 in the sleeve 57 to permit limited relative axial movement between the shaft and the sleeve.

As previously mentioned, the pressure in the region above the seal 53 is significantly greater than the pressure in the valve chamber 16. The seal is therefore designed to be partly balanced, in known manner, in order to reduce the axial lead on the seal resulting from this pressure difference, and hence reduce the torque applied by the seal.

Thus, the bore 64 in the sleeve 57 is stepped, the reduced-diameter portion 63 of the shaft 21 passing through a corresponding reduced diameter part 65 of the bore 64. This effectively reduces the ratio between the areas of the sleeve 57 which are subjected to the higher pressure and lower pressure respectively so as to reduce the net effective downward closing force on the seal.

It is also desirable to accommodate any slight angular misalignment between the shaft 21 and the seal 53, and for this purpose the portion of the shaft 21 which is surrounded by the upper part of the sleeve 57 is encircled by a sleeve 66 of natural or synthetic rubber or other suitable resiliently yieldable material. This permits tilting of the shaft 21 relative to the sleeve 57, while still maintaining the contact between the shaft and sleeve. Corresponding tilting of the lower part 63 of the shaft 21 is permitted by enlargement of the bores 65, 67 and 69 through which the part 21 of the shaft passes.

The use of polycrystalline diamond surfaces to form the rotating seal provides a seal which is very resistant to wear and to abrasion from drilling fluid while at the same time providing low resistance to relative rotation, particularly after an initial period of use during which the polycrystalline diamond surfaces effect mutual smoothing of one another.

Polycrystalline diamond is a particularly suitable form of superhard material for use in a pressure seal according to the invention. As well as having the desired wear and erosion resistance, the material is readily available being commonly used for cutting elements in rotary drag-type drill bits. The material is available as circular compacts comprising a layer of polycrystalline diamond bonded, in a high pressure, high temperature press, to a substrate of less hard material, such as cemented tungsten carbide. The annular sealing discs of the pressure seal may be readily formed from circular compacts of this kind.

However, the invention is not limited to the use of polycrystalline diamond, and other forms of superhard material may be employed, such as cubic boron nitride and amorphous diamond-like carbon (ADLC).

In a modified arrangement, not shown, the multiple choke 20 may be located on the axis of the bias unit so that the shaft 21 passes downwardly through the centre of the choke, the choke apertures then being annular. In this case the multiple choke itself serves as a labyrinth seal between the cavity 16 and the central passage 17 in the bias unit and it is therefore not necessary to provide the rotating seal 53, or similar seal, between the shaft and the body structure of the bias unit.

I claim:

1. A modulated bias unit, for controlling the direction of drilling of a rotary drill bit when drilling boreholes in subsurface formations, comprising at least one hydraulic actuator having a movable thrust member which is hydraulically displaceable outwardly for engagement with formation surrounding the borehole being drilled, valve means which modulate fluid pressure supplied to the actuator in synchronism with rotation of the drill bit, and in selected phase relation thereto so that, as the drill bit rotates, the movable thrust member is displaced outwardly at the same selected rotational position so as to bias the drill bit laterally and thus control the direction of drilling, said valve means being located within a cavity in the body structure and operated by a shaft which is rotatable relatively to the body structure and extends into said cavity through a rotatable pressure seal, said pressure seal comprising two annular sealing members concentric with the shaft, one member being mounted on the body structure and the other member being carried on the shaft, the members having engaging sealing faces formed of superhard material.

2. A modulated bias unit according to claim 1, wherein said valve means are located between a source of fluid under pressure and said hydraulic actuator, and are operable to place said actuator alternately into and out of communication with said source of fluid under pressure.

3. A modulated bias unit according to claim 1, wherein said hydraulic actuator comprises a chamber located adjacent the outer periphery of the unit, inlet means for supplying fluid to said chamber from said source of fluid under pressure, outlet means for delivering fluid from said chamber to a lower pressure zone, and said movable thrust member being mounted for movement outwardly and inwardly with respect to the chamber in response to fluid pressure therein.

4. A modulated bias unit according to claim 1, wherein there are provided a plurality of said hydraulic actuators spaced apart around the periphery of the unit, said valve means being arranged to modulate the fluid pressure supplied to said actuators so as to operate each actuator in succession as the unit rotates.

5. A modulated bias unit according to claim 1, further comprising a formation-engaging member pivotally mounted on the body structure for pivotal movement about a pivot axis located to one side of said movable thrust member, the formation-engaging member being operatively coupled to the thrust member whereby outward movement of the thrust member causes outward pivoting movement of the formation-engaging member.

6. A modulated bias unit according to claim 1, wherein said sealing members are annular discs and the engaging sealing faces are substantially flat.

7. A modulated bias unit according to claim 1, wherein each sealing member comprises a layer of superhard material bonded to a substrate of less hard material.

8. A modulated bias unit according to claim 1, wherein the sealing member carried on the shaft is provided on a carrier which is axially displaceable with respect to the shaft.

9. A modulated bias unit according to claim 8, wherein said carrier comprises a cylindrical sleeve surrounding the shaft, the sealing member being mounted on one annular end face of the sleeve, said sleeve being slidable axially of the shaft and resilient annular fluid-tight sealing means being disposed between the sleeve and the shaft.

10. A modulated bias unit according to claim 8, wherein a portion of the shaft passing through the carrier reduces in cross-section and engages a correspondingly reducing cross-section passage in the carrier.

11. A modulated bias unit according to claim 8, wherein means are provided to allow the longitudinal axis of the shaft to tilt relative to the longitudinal axis of the carrier, so as to permit said sealing faces to remain in sealing engagement upon tilting of the shaft relative to the body structure.

12. A modulated bias unit according to claim 11, wherein said means comprise a sleeve of resiliently deformable material disposed between an internal surface on the carrier and an external surface on said shaft.

13. A modulated bias unit according to claim 1, wherein said superhard material is selected from polycrystalline diamond, cubic boron nitride and amorphous diamond-like carbon.

14. A rotatable pressure seal between a relatively rotatable shaft and body structure, comprising two annular sealing members concentric with the shaft, one member being mounted on the body structure and the other member being carried on the shaft, the members having engaging sealing faces formed of superhard material, the sealing member carried on the shaft being provided on a carrier which is axially displaceable with respect to the shaft and comprises a cylindrical sleeve surrounding the shaft, the sealing member being mounted on one annular end face of the sleeve, said sleeve being slidable axially of the shaft, and resilient annular fluid-tight sealing means being disposed between the sleeve and the shaft.

15. A rotatable pressure seal between a relatively rotatable shaft and body structure, comprising two annular sealing members concentric with the shaft, one member being mounted on the body structure and the other member being carried on the shaft, the members having engaging sealing faces formed of superhard material, the sealing member, carried on the shaft being provided on a carrier which is axially displaceable with respect to the shaft, and wherein a portion of the shaft passing through the carrier reduces in cross-section and engages a correspondingly reducing cross-section passage in the carrier.

16. A rotatable pressure seal between a relatively rotatable shaft and body structure, comprising two annular sealing members concentric with the shaft, one member being mounted on the body structure and the other member being carried on the shaft, the members having engaging sealing faces formed of superhard material, the sealing member carried on the shaft being provided on a carrier which is axially displaceable with respect to the shaft, and wherein the shaft and carrier have respective longitudinal axes, means being provided to allow the longitudinal axis of the shaft to tilt relative to the longitudinal axis of the carrier, so as to permit said sealing faces to remain in sealing engagement upon tilting of the shaft relative to the body structure.

17. A pressure seal according to claim 16, wherein said means comprise a sleeve of resiliently deformable material disposed between an internal surface on the carrier and an external surface on said shaft.

* * * * *